US009030114B2

(12) United States Patent
Murakami

(10) Patent No.: US 9,030,114 B2
(45) Date of Patent: May 12, 2015

(54) LED DRIVE CIRCUIT AND LED DRIVING METHOD

(75) Inventor: Kohzaburoh Murakami, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 289 days.

(21) Appl. No.: 13/494,050

(22) Filed: Jun. 12, 2012

(65) Prior Publication Data

US 2013/0049623 A1 Feb. 28, 2013

(30) Foreign Application Priority Data

Aug. 26, 2011 (JP) ..... 2011-185146

(51) Int. Cl.
*H05B 37/02* (2006.01)
*H05B 33/08* (2006.01)

(52) U.S. Cl.
CPC ..... *H05B 33/0818* (2013.01)

(58) Field of Classification Search
USPC ..... 315/224
See application file for complete search history.

(56) References Cited

U.S. PATENT DOCUMENTS

2008/0150450 A1* 6/2008 Starr et al. ..... 315/294
2008/0164825 A1* 7/2008 Terlizzi et al. ..... 315/210
2012/0181940 A1* 7/2012 Snelten et al. ..... 315/186

FOREIGN PATENT DOCUMENTS

JP 2002-203988 A 7/2002
JP 2007-220812 A 8/2007
JP 2009-224080 A 10/2009
JP 2011-22930 A 2/2011
JP 2011-70957 A 4/2011

* cited by examiner

*Primary Examiner* — Alexander H Taningco
*Assistant Examiner* — Tanina Bradley
(74) *Attorney, Agent, or Firm* — Birch, Stewart, Kolasch & Birch, LLP

(57) ABSTRACT

An LED drive circuit of the present invention carries out, by use of a DC-to-DC converter, light control of an LED. The light control is carried out, in a region where a light control level is equal to or greater than a certain light control level, by a DC light control method for adjusting a pulse height of an LED drive current. The light control is carried out, in a region where a light control level is equal to or less than the certain light control level, by a PDM light control method for adjusting an off period of oscillation of the DC-to-DC converter.

3 Claims, 11 Drawing Sheets

FIG. 2 CONVENTIONAL ART

FIG. 3 CONVENTIONAL ART

FIG. 4 CONVENTIONAL ART

LED DRIVE CIRCUIT AND LED DRIVING METHOD

This Nonprovisional application claims priority under 35 U.S.C. §119 on Patent Application No. 2011-185146 filed in Japan on Aug. 26, 2011, the entire contents of which are hereby incorporated by reference.

TECHNICAL FIELD

The present invention relates to an LED (Light Emitting Diode) drive circuit of buck converter type or buck-boost converter type.

BACKGROUND ART

An LED drive circuit has been known that (i) supplies a constant current to an LED by use of a DC-to-DC converter and (ii) carries out light control of the LED by changing a value of the constant current. As a method for supplying a constant current to an LED, a method is known in which an output current is detected by use of a resistor etc. and carries out voltage feedback so that the LED receives a desired current (see, for example, Patent Literature 1). However, this method will cause a problem that flickering occurs typically in a light control region of not more than 10%.

In order to avoid the problem, a method is known in which a converter such as a buck converter or a buck-boost converter is used and carries out light control by PWM (Pulse-Width Modulation) light control (see, for example, Patent Literature 2).

CITATION LIST

Patent Literatures

Patent Literature 1
Japanese Patent Application Publication, Tokukai, No. 2002-203988 A (Publication Date: Jul. 19, 2002)
Patent Literature 2
Japanese Patent Application Publication, Tokukai, No. 2011-70957 A (Publication Date: Apr. 7, 2011)

SUMMARY OF INVENTION

Technical Problem

The conventional method, though, poses the following dilemma. If an oscillation frequency of a buck converter or of a buck-boost converter is not high enough against a PWM light control frequency, then a change in light control level becomes so recognizable as to hinder smooth light control in a case where light is dimmed. On the other hand, if the oscillation frequency of the buck converter or the buck-boost converter is increased in order to avoid the problem of coarse adjustment, then it leads to switching loss and therefore to impaired efficiency.

For example, in a case where light control of an LED drive circuit of buck converter type is attempted in increments of n % from 100%, it is necessary for an oscillation frequency to be at least 100/n times as much as a light control frequency. For example, if, in order to obtain smooth light control, light control is attempted in increments of 1% on the premise that an oscillation frequency of a converter is 200 kHz, a light control frequency is 2 kHz. This causes concern for noises from electronic components since 2 kHz is in the range of an audible frequency.

In order to prevent the noises, the light control frequency needs only be set to a value greater than the audible frequency. However, in order to achieve light control in increments of 1%, an oscillation frequency is required to be 2 MHz, which is 100 times as much as the upper limit of the audible frequency of 20 kHz. Such a high frequency brings about significant switching loss, and therefore is unrealistic.

The present invention has been made in view of the problem, and it is an object of the present invention to achieve a highly efficient LED drive circuit that can carry out smooth LED light control without generating noises.

Solution to Problem

In order to solve the foregoing problem, the present invention is directed to an LED drive circuit which is characterized in that the LED drive circuit carries out, by use of a DC-to-DC converter, light control of an LED, the light control being carried out, in a region where a light control level is equal to or greater than a certain light control level, by a light control method for adjusting a pulse height of an LED drive current, and the light control being carried out, in a region where a light control level is equal to or less than the certain light control level, by a light control method for adjusting an off period of oscillation of the DC-to-DC converter.

With the configuration, light control can be carried out, in a region where a light control level is equal to or greater than the certain light control level, by adjusting a pulse height of an LED drive current. This makes it unnecessary to increase an oscillation frequency of a DC-to-DC converter even in a case where a light control level is increased. Also, light control is carried out, in a region where a light control level is equal to or less than the certain light control level, by adjusting an off period of oscillation of the DC-to-DC converter. This causes an oscillation frequency of a DC-to-DC converter to increase in a case where a light control level is increased. However, such light control is carried out only in a limited part of the entire light control region. This prevents the oscillation frequency from excessively increasing. As a result, even in a case where an oscillation frequency, during a period when a light control level is minimum, is set to an audible frequency (20 kHz, for example) or more in order to prevent noises, the maximum oscillation frequency of a DC-to-DC converter does not excessively increase. This allows an increase in switching loss to be suppressed.

Advantageous Effects of Invention

According to an LED drive circuit of the present invention, light control can be carried out, in a region where a light control level is equal to or greater than the certain light control level, by adjusting a pulse height of an LED drive current. This makes it unnecessary to increase an oscillation frequency of a DC-to-DC converter even in a case where a light control level is increased. Also, light control is carried out, in a region where a light control level is equal to or less than the certain light control level, by adjusting an off period of oscillation of the DC-to-DC converter. This causes an oscillation frequency of a DC-to-DC converter to increase in a case where a light control level is increased. However, such light control is carried out only in a limited part of the entire light control region. This prevents the oscillation frequency from excessively increasing. As a result, even in a case where an oscillation frequency, during a period when a light control level is minimum, is set to an audible frequency (20 kHz, for example) or more in order to prevent noises, the maximum oscillation frequency of a DC-to-DC converter does not excessively increase. This produces an effect of allowing an increase in switching loss to be suppressed.

DESCRIPTION OF EMBODIMENTS

Basic Configuration of LED Drive Circuit Using DC-to-DC Converter

An embodiment of the present invention is described below in detail with reference to the drawings. The following description will discuss an example in which the present invention is applied to an LED drive circuit of buck converter type. Note, however, that the present invention is applicable to LED drive circuits of buck converter type and of buck-boost converter type.

Figure 2:
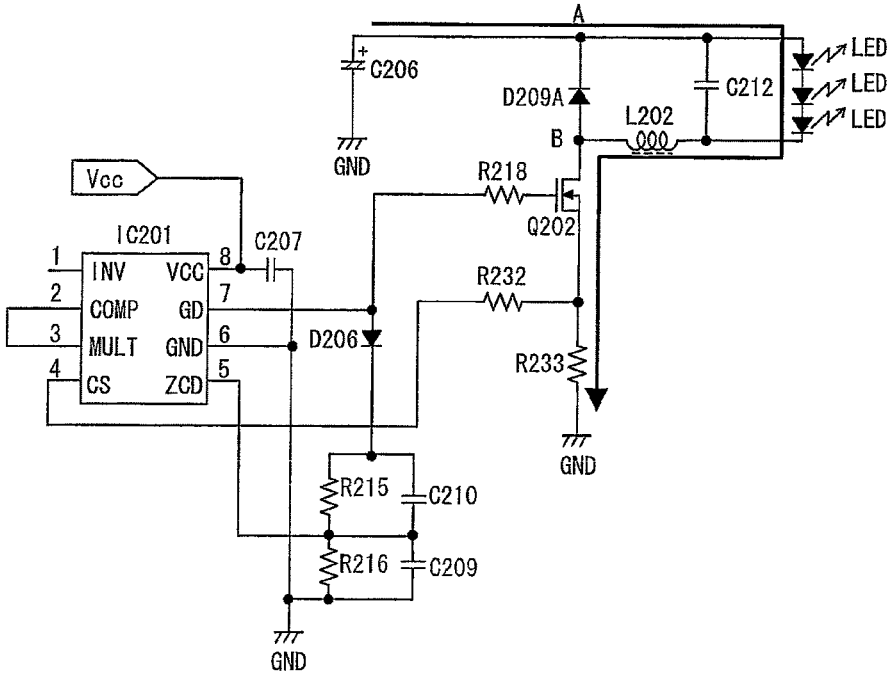
FIG. 2 is a circuit diagram showing (i) a configuration of an LED drive circuit employing a conventional PWM light control method and (ii) a pathway of an electric current during excitation.
Figure 3:
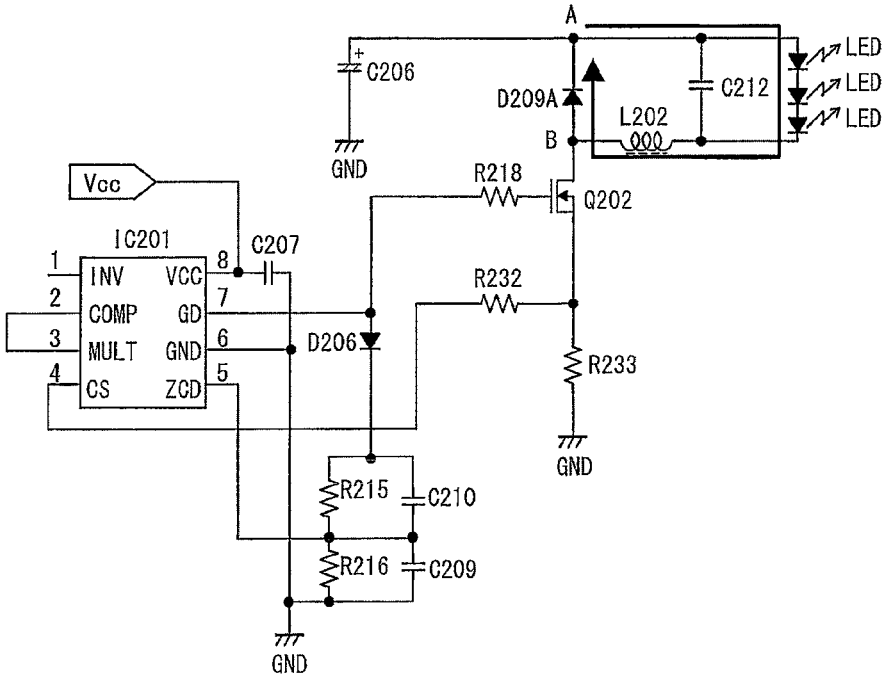
FIG. 3 is another circuit diagram showing (i) a configuration of an LED drive circuit employing a conventional PWM light control method and (ii) a pathway of an electric current during commutation.
Figure 4:
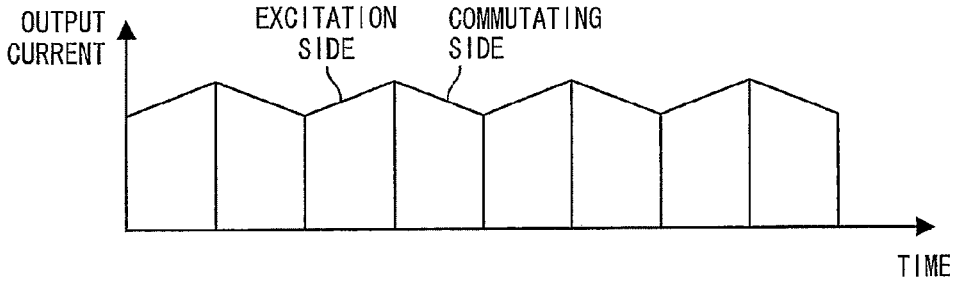
FIG. 4 is a graph illustrating an LED drive current in a case where an LED is driven by the LED drive circuit shown in FIGS. 2 and 3.

FIG. 2 and FIG. 3 are circuit diagrams each showing a typical circuit configuration of an LED drive circuit employing a conventional PWM light control method. Each of the LED drive circuits is a constant current circuit using, as a control IC, an L6562 manufactured by STMicroelectronics N.V. FIG. 4 illustrates how an electric current flows to an LED in a case where the LED is driven by the LED drive circuit shown in each of FIG. 2 and FIG. 3. The LED drive circuit includes a DC-to-DC converter of buck converter type (hereinafter, referred to simply as a converter) including an inductor L202, a transistor Q202, a diode D209A, and a capacitor C212.

In FIG. 4, upward straight lines, each of which is described as an excitation side, show an electric current (hereinafter, referred to as an exciting current) outputted in a case where an electric charge stored by a capacitor C206 is supplied to the LED so as to cause the LED to emit light. It should be noted that the LED drive circuit includes a rectifier circuit section (not shown in FIGS. 2 and 3) and a smoothing capacitor (corresponding to the capacitor C206 shown in FIGS. 2 and 3). Commercial power supply is supplied to a diode bridge of the rectifier circuit section so that an alternating current is converted into a direct current. The direct current is smoothed out by the smoothing capacitor so as to be used as a drive current for the LED.

An LED load, the inductor L202, the transistor Q202, and a resistor R233 are connected in series, in this order, between ground and a positive terminal of the capacitor C206. The LED load is constituted by three LEDs connected in series in FIGS. 2 and 3. Note that the number of the LEDs is not limited to a specific one. In a case where the number of the LEDs is large, a plurality of LED arrays, in each of which a plurality of LEDs are connected in series, can be connected in parallel.

During a period when the exciting current shown in FIG. 4 is flowing, the transistor Q202 is in an on state, and the exciting current flows to the positive terminal of the capacitor C206, the LED load, the inductor L202, the transistor Q202, the resistor R233, and a negative terminal (GND) of the capacitor C206, in this order. The exciting current flows while exciting the inductor L202, and therefore has a waveform which shows an upward straight line with a constant slope (see an arrow indicated by a solid-line in FIG. 2).

A resistor R232 is connected between (i) a connecting point of the transistor Q202 and the resistor R233 and (ii) a CS terminal of an IC201 which is a control IC. This causes the exiting current to be converted into a voltage by the resistor R233. The voltage across the resistor R233 is supplied to the IC201 via the resistor R232. The IC201 thus monitors the exiting current in terms of the voltage across the resistor R233. Specifically, the IC201 turns off the transistor Q202 when a voltage detected via the CS terminal reaches a predetermined voltage. A signal for turning off the transistor Q202 is supplied from a GD terminal of the IC201 to a gate of the transistor Q202 via a resistor R218.

When the transistor Q202 is turned off, the inductor L202 (which has been excited) still attempts to continuously flow the electric current. However, since the transistor Q202 has been turned off, the electric current is commutated via the diode D209A. The diode D209A is provided between the nodes A and B so that its anode is connected to the node B and its cathode is connected to the node A. The node A is a connecting point of the LED load and the capacitor 206, and the node B is a connecting point of the inductor L202 and the transistor Q202.

While the transistor Q202 is in an off state, an output current is a commutating current (see FIG. 4). An output current pathway during this period follows, as shown by an arrow indicated by a solid-line in FIG. 3, a line running from the inductor L202 to the diode D209A to the LED load to the inductor L202. Since the commutating current is caused by an electromotive force of the inductor L202, it has a waveform which shows a downward straight line with a constant slope (see a commutating side shown in FIG. 4).

Additionally, a node C is connected to the GD terminal of the IC201. The node C is a connecting point of the resistor R218 and the diode D206. An anode of the diode D206 is connected to the node C. A cathode of the diode D206 is connected to a charge/discharge circuit, which includes resistors R215 and 216 and capacitors C210 and C209. In the charge/discharge circuit, (i) the resistors R215 and R216 connected in series and (ii) the capacitors C210 and C209 connected in series, are connected in parallel between the cathode of the diode D206 and the GND terminal. Also, (a) a node between the resistors R215 and R216 and (b) a node between the capacitors C210 and C209, are connected to a ZCD terminal of the IC201.

While the transistor Q202 is in an on state, an electric charge is stored by the capacitor C209 through the following pathways: (i) a pathway running from the GD terminal of the IC201 to the diode D206 to the resistor R215 to capacitor C209 and (ii) a pathway running from the capacitor C210 to the capacitor C209. Note that the electric charge starts to be discharged via the resistor R216 when the transistor Q202 is turned off. When a voltage across a capacitor C209 falls below a threshold voltage of the ZCD terminal to which the capacitor C209 is connected, the IC201 operates so as to turn on the transistor Q202 again. This results in a pulsating flow to the LED as shown in FIG. 4. Therefore, the LED continuously emits light.

As described above, when a voltage of the CS terminal of the IC201 rises above a threshold value, the transistor Q202 is turned "off" from "on." On the other hand, when a voltage of the ZCD terminal of the IC201 falls below or equal to the threshold value, the transistor Q202 is turned "on" from "off." Therefore, in the operations of the converters shown in FIGS. 2 and 3, the drive current of the LED becomes, as shown in FIG. 4, a pulsating current whose pulse height is constant. Also, points of the pulsating current corresponding to the bottoms of the pulsating current shown in FIG. 4 are determined by a voltage of the GD terminal of the IC201 and a time constant (which is determined by R215, C210, R216, and C209) of the charge/discharge circuit in which charging/discharging is carried out via the diode D206.

Note here that it is possible to change the threshold value of the CS terminal of the IC201 in accordance with a voltage level of a signal to be supplied to an MULT terminal. This is because a multiplier in the IC201 can be changed in accordance with the voltage to be supplied to the MULT terminal. The light control of the LED is made possible by a DC light control method in which the current pulse height of the output current waveform shown in FIG. 4 is changed in accordance with a change in the threshold value of the CS terminal of the IC201.

(Configuration of LED Drive Circuit in Accordance with the Present Embodiment)

Figure 1:
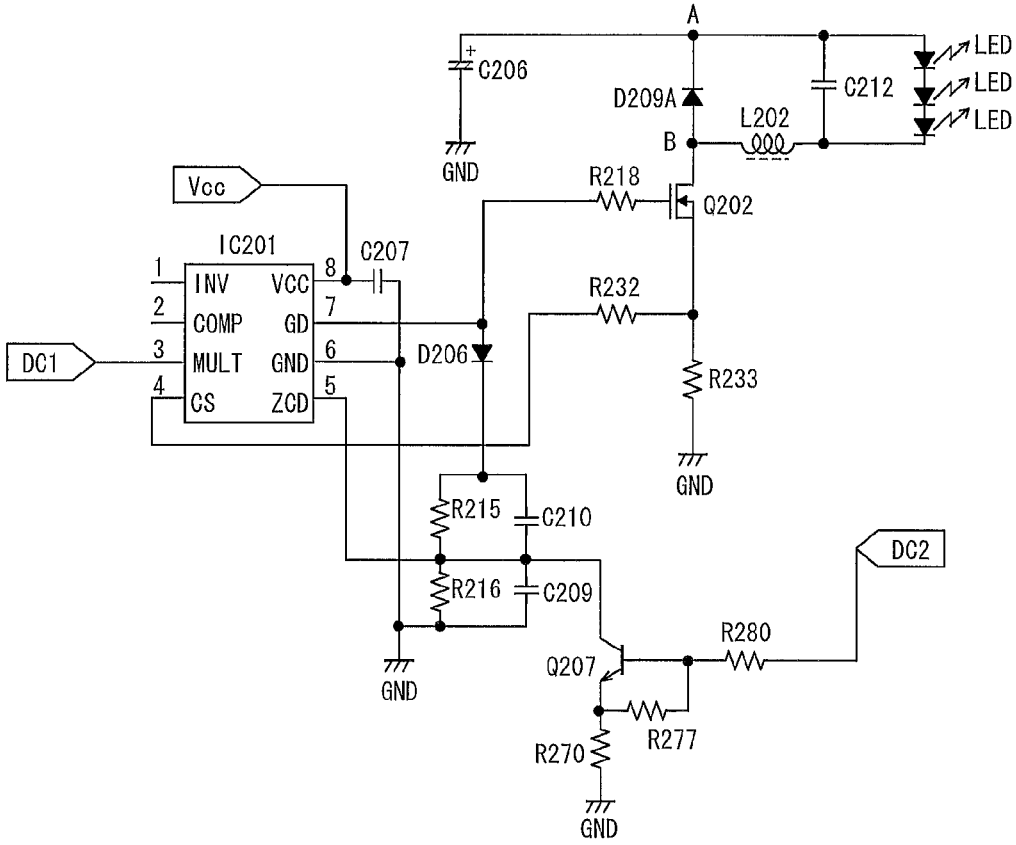
FIG. 1 is a circuit diagram showing an embodiment of the present invention and a configuration of an LED drive circuit.

An LED drive circuit of the present embodiment is different from the LED drive circuits shown in FIGS. 2 and 3 in that an emitter follower circuit is further provided in parallel with the resistor R216 for discharging the electrical charge of the capacitor C209 (see FIG. 1). The emitter follower circuit includes a transistor Q207 and resistors R270, R277, and R280. More specifically, a collector of the transistor Q207 is connected to the node between the resistors R215 and R216 and to the node between the capacitors C210 and C209. An emitter of the transistor Q207 is grounded via the resistor R270. The resistor R277 is provided between a base and the emitter of the transistor Q207. The base of the transistor Q207 is further connected to a DC voltage supply DC2 via the resistor R280. By changing a voltage level supplied to the DC voltage supply DC2, a discharge time constant of a charge/discharge circuit can be made variable. This allows an adjustment in "off" period of a converter.

The LED drive circuit shown in FIG. 1 also differs from the LED drive circuit shown in FIGS. 2 and 3 in that the MULT terminal of the IC201 is connected to a DC voltage supply DC1, instead of the MULT terminal being connected to a COMP terminal, so that the voltage level of the MULT terminal is made variable. Except for this configuration, the LED drive circuit shown in FIG. 1 is identical to the LED drive circuits shown in FIGS. 2 and 3.

According to the LED drive circuit shown in FIG. 1, the light control of the LED can be controlled by at least one of the DC light control method and a light control method (PDM (Pulse-Density Modulation) method) in which a fluctuation in "off" period of the converter is used.

As shown in FIG. 1, the present LED drive circuit has two DC voltage supply systems (i.e., DC1 and DC2) whose voltages are variable. One of them is connected to the MULT terminal of the IC201, and the other is connected to the emitter follower circuit. In a region where the light control level ranges from 100% to a certain light control level (tentatively 30% in the present case), (i) the DC voltage of the DC voltage supply DC2 to be connected to the emitter follower circuit is fixedly set to the maximum voltage of the variable voltages and (ii) the DC voltage of the DC voltage supply DC 1 to be connected to the MULT terminal is changed to about 0.3V from 1V. This achieves DC light control in a region where the light control level is 30% or greater.

Figure 5:
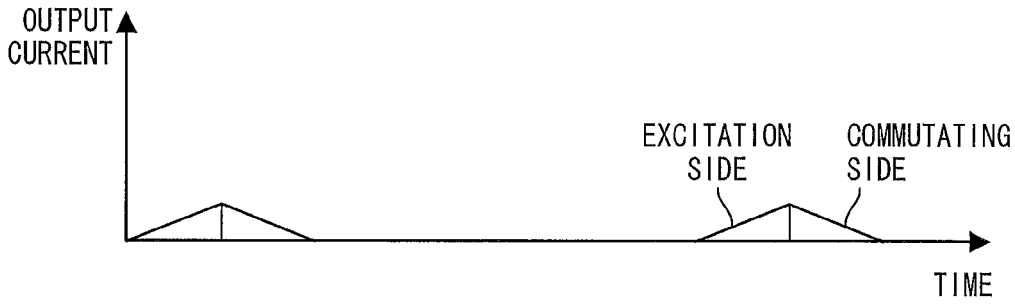
FIG. 5 is a graph illustrating an LED drive current in a case where PDM light control is carried out by the LED drive circuit shown in FIG. 1.

In a region where the light control level is in the range of 0% to 30%, (i) the DC voltage of the DC voltage supply DC 1 to be connected to the MULT terminal is fixedly set to 0.3 V and (ii) the DC voltage of the DC voltage supply DC2 to be connected to the emitter follower circuit is reduced as desired. With this configuration, the PDM light control is achieved, in the region where the light control level is 30% or less, by fluctuating the "off" period of converter oscillation. FIG. 5 illustrates a waveform of an output current flowing to the LED during the PDM light control. It should be noted that a light control level at which the DC light control is switched to the PDM light control or vice versa is not particularly limited, and is therefore adjustable to any desired light control level.

Figure 6:
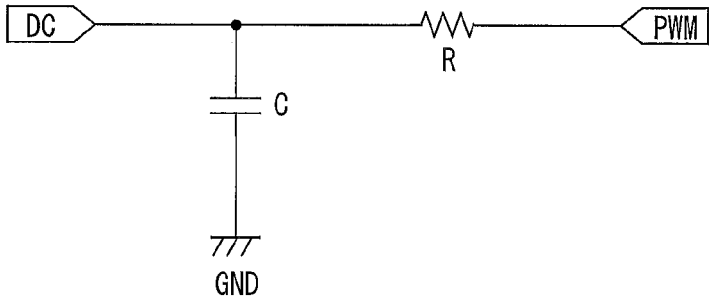
FIG. 6 is a circuit diagram showing an example of a configuration of a voltage-variable DC voltage supply to be used for the LED drive circuit shown in FIG. 1.

Signal sources, in each of which a PWM signal received from a microcomputer is converted into a DC signal by an integration circuit, can be used as the respective two DC voltage supply systems (see, for example, FIG. 6).

Light control in which a DC light control method and a PDM light control method are combined can be achieved, as with the LED drive circuit in FIG. 1, by (i) causing the microcomputer to directly determine, as temporal absolute value, an "on" period and an "off" period of the converter or (ii) directly determining the "on" and "off" periods of the transistor Q202 in FIGS. 2 and 3 with the use of a DSP (Digital Signal Processor) etc. The following description will discuss a difference between the controlling of the LED drive circuit in FIG. 1 and the method in which the "on" period and the "off" period of the converter oscillation are directly determined.

In the LED drive circuit in FIG. 1, the "on" period is indirectly determined by (i) a pulse height of a pulse current and (ii) a current slope caused by an L value of a choke coil. The "off" period is achieved by (a) converting, by a type of technique commonly used in an analog circuit, a PWM signal received from a microcomputer etc. into a DC voltage and then (b) supplying the DC voltage to the emitter follower circuit to be connected to the ZCD terminal of the IC201 which is a control IC. Since the LED drive circuit shown in FIG. 1 does not determine the "on" period and the "off" period of the converter by respective temporal absolute values, an oscillation frequency contains a small frequency fluctuation caused by a periodic current fluctuation (pulsating flow) of an input voltage. This makes it possible to prevent unwanted radiation from concentrating on a specific frequency. As such, it is possible to reduce a level of noise radiation.

As described earlier, by using two different voltage supplies, (i) light control can be carried out, in a case where a light control level is in the range of a certain light control level (30%, for example) to 100%, by a DC light control method for adjusting a pulse height of an LED drive current and (ii) light control can be carried out, in a case where a light control level is equal to or less than the certain light control level, by a PDM light control method for adjusting an off period of oscillation of the DC-to-DC converter. In addition to this, the LED drive circuit shown in FIG. 1 is capable of further carrying out the following control in order to increase efficiency.

Specifically, according to the LED drive circuit in FIG. 1, a control is carried out so that f(dim.min)>20 kHz and f(max) >f(dim.max) (See FIG. 7) are met, where (i) f(dim.min) is an oscillation frequency during a minimum audible light control, (ii) f(dim.max) is an oscillation frequency during a maximum light control, and (iii) f(max) is a maximum oscillation frequency. The control itself can be achieved by software installed in a microcomputer which software creates the two DC voltage supplies, DC1 and DC2.

It should be noted that, in the LED driver circuit of the present embodiment, an oscillation frequency is not directly determined by a microcomputer etc., and that the "on" period and the "off" period of the converter are instructed to the converter by use of methods differing from each other. Accordingly, the oscillation frequency of the converter to be determined by those methods becomes affected by a small fluctuation (pulsating flow) of an input voltage, and therefore periodically fluctuates. Hence, the oscillation frequency actually means an average oscillation frequency (i.e. an averaged value of the periodic fluctuation of the oscillation frequency), but is herein referred to simply as the oscillation frequency.

Also note that "during minimum audible light control" means a lower limit of a light control rate at which electric power noises are observed. This means that electric power noises are no longer observed in a region where a light control rate is less than that during the minimum audible light control. That is, it is clear that no noise is observed when an oscillation frequency is outside the audible frequency. Note, however, that the noises are still not observed if, even when the oscillation frequency falls within the audible frequency, a voltage passing through a circuit is so low that the amount of sound pressure creating the noises is small. As such, the present embodiment is configured such that the oscillation frequency is greater than the audible frequency during the minimum audible light control.

The maximum oscillation frequency is a frequency which causes the oscillation frequency of the converter to be a maximum level in the entire light control region. In a case where an oscillation frequency is controlled as shown in FIG. 7, the oscillation frequency becomes maximum at the light control level (30%, for example) at which the light control methods are switched from one method to the other.

Figure 7:
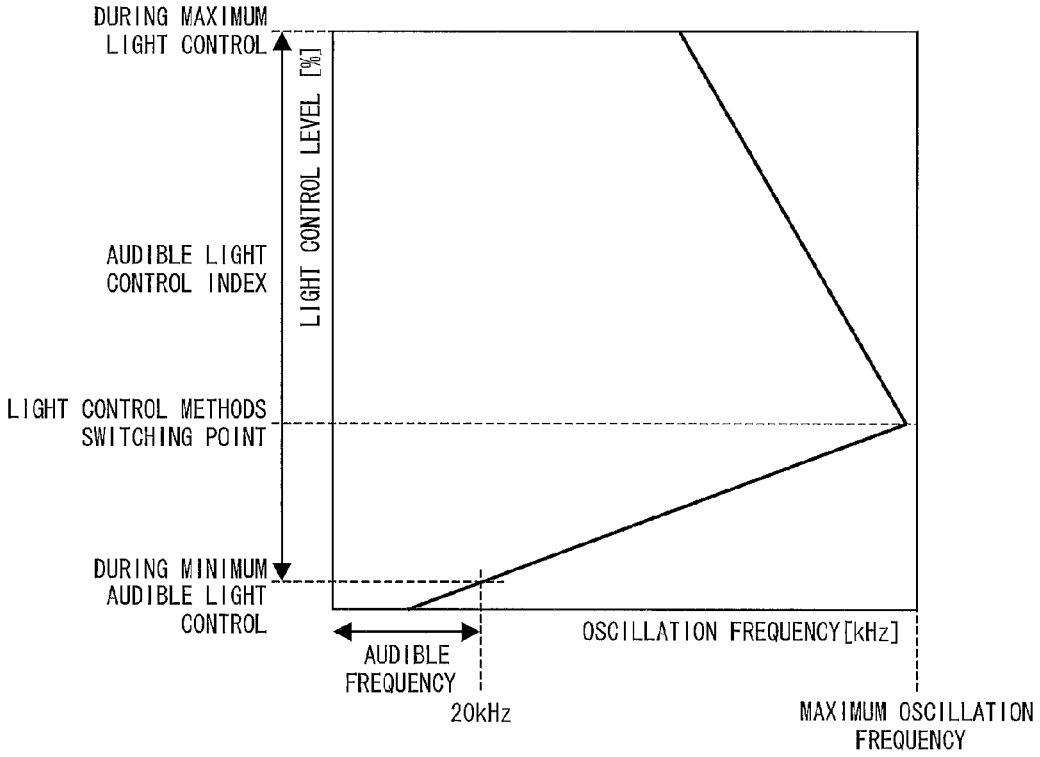
FIG. 7 is a graph illustrating a relationship, in a case where light control is carried out by use of the LED drive circuit shown in FIG. 1, between an oscillation frequency of a converter and a light control level of an LED.

The control as shown in FIG. 7 causes the oscillation frequency to be low in the vicinity of the region where (i) the light control is carried out at 100% and (ii) a large amount of heat is generated. This allows a reduction in switching loss, and ultimately allows heat generation of a switching element to be effectively suppressed (Q202 and D209A in FIG. 1).

Furthermore, in a case where an oscillation frequency, in the vicinity of the light control region where the DC light control and the PDM light control are switched from one light control to the other, is set to be higher than an oscillation frequency in the vicinity of the region where the light control is carried out at 100%, the oscillation frequency in the vicinity of the light control region becomes a maximum oscillation frequency. Since the light control level is determined in accordance with a ratio of an oscillation frequency to the maximum oscillation frequency, serving as a basis, it is possible to increase an oscillation frequency during a period when light control is carried out at a minimum level. For example, in a case where (i) a light control level at which the DC light control and the PDM light control are switched from one light control to the other is 30% and (ii) light control is carried out in increments of 1%, the maximum oscillation frequency f(max) need only be 600 kHz, merely 30 times as much as the oscillation frequency f(dim.min) during the minimum audible light control, even if the oscillation frequency f(dim.min) is set to 20 kHz.

Figure 8:
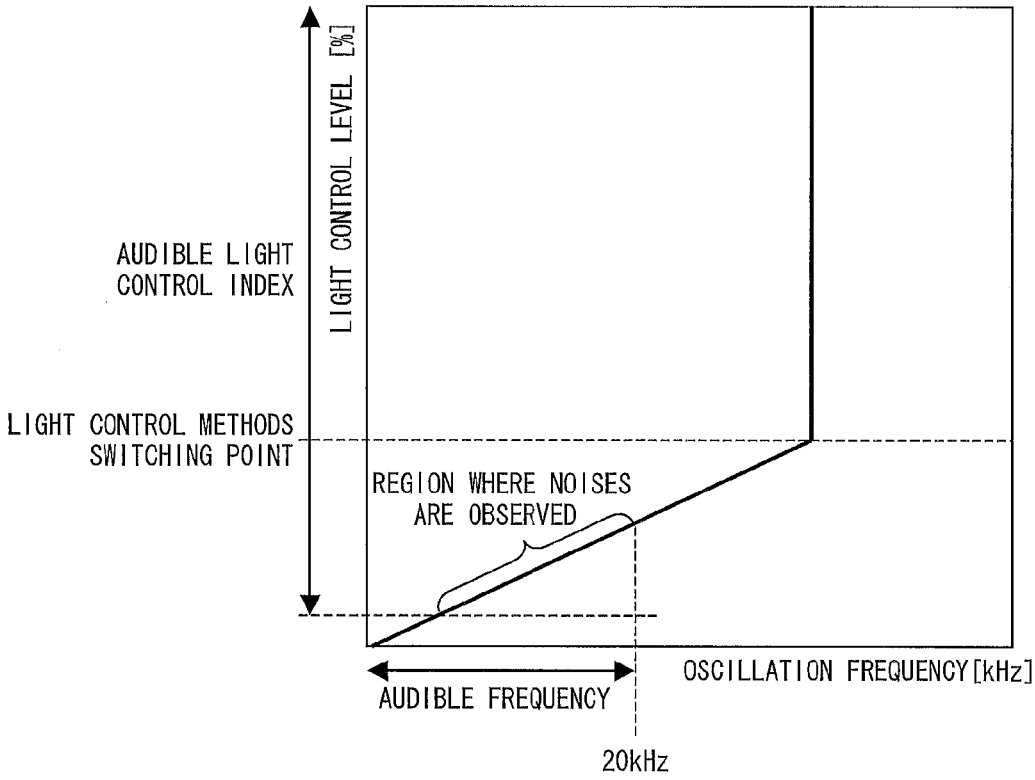
FIG. 8 is a graph illustrating an example of a relationship, in a case where the light control shown in FIG. 7 is modified so as to prevent a fluctuation of an oscillation frequency in a DC light control region, between the oscillation frequency and a light control level of an LED.

In a case where (i) an oscillation frequency is not controlled as shown in FIG. 7 and (ii) an oscillation frequency is set to be approximately equal, when the light control is carried out at 100%, to the oscillation frequency in FIG. 7, the oscillation frequency is present simultaneously in an audible light control index region and in an audible frequency region, when light is dimmed. This leads to a problem that noises are observed from electronic components (See FIG. 8).

Figure 9:
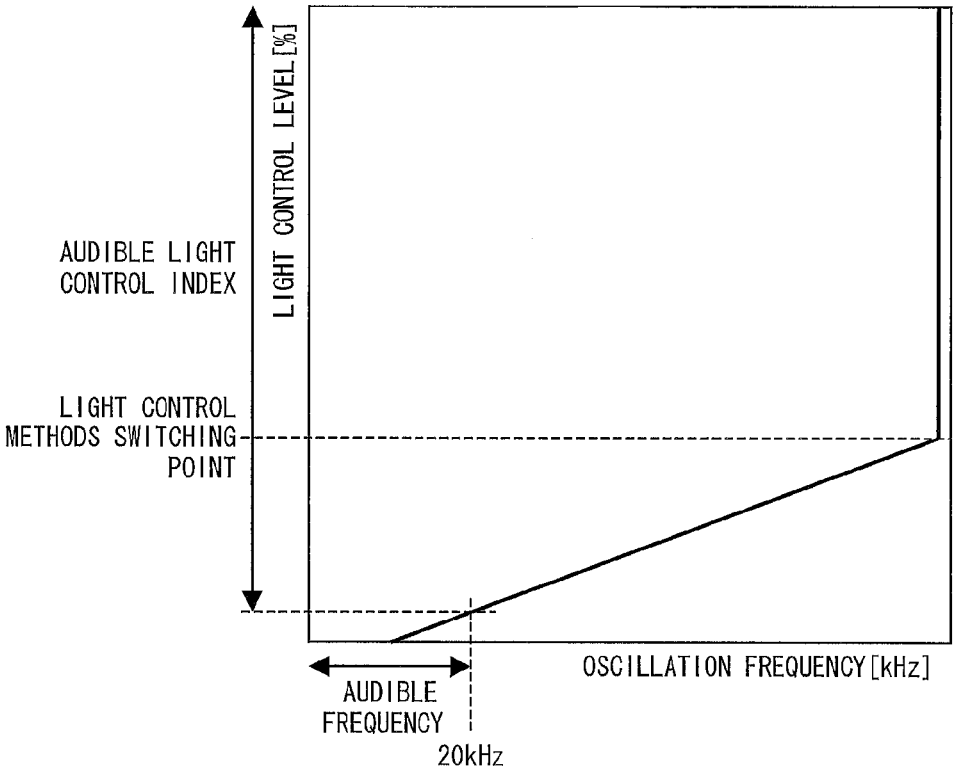
FIG. 9 is another graph illustrating an example of a relationship, in a case where the light control shown in FIG. 7 is modified so as to prevent a fluctuation of an oscillation frequency in a DC light control region, between the oscillation frequency and a light control level of an LED.

The oscillation frequency remains maximum at any given time in the region where the DC light control is carried out, in a case where, as shown in FIG. 9, an oscillation frequency is set (i) not to be present in the audible frequency region while present in the audible light control index region and (ii) not to fluctuate in a region where the DC light control is carried out. In such a case, the oscillation frequency when the light control is carried out at 100% becomes high as compared with the case where the oscillation frequency is controlled as shown in FIG. 7. However, even in such a case, the maximum oscillation frequency ends up being merely 30 times as much as the upper limit of the audible frequency of 20 kHz (in a case where (i) a light control level at which the DC light control and the PDM light control are switched from one light control to the other is 30% and (ii) light control is carried out in increments of 1%). This brings about an effect of sufficiently reducing switching loss, as compared with a case where a PWM light control is carried out in the entire light control region. Hence, the present invention encompasses the control shown in FIG. 9.

(Modification of LED Drive Circuit in Accordance with the Present Embodiment)

Figure 10:
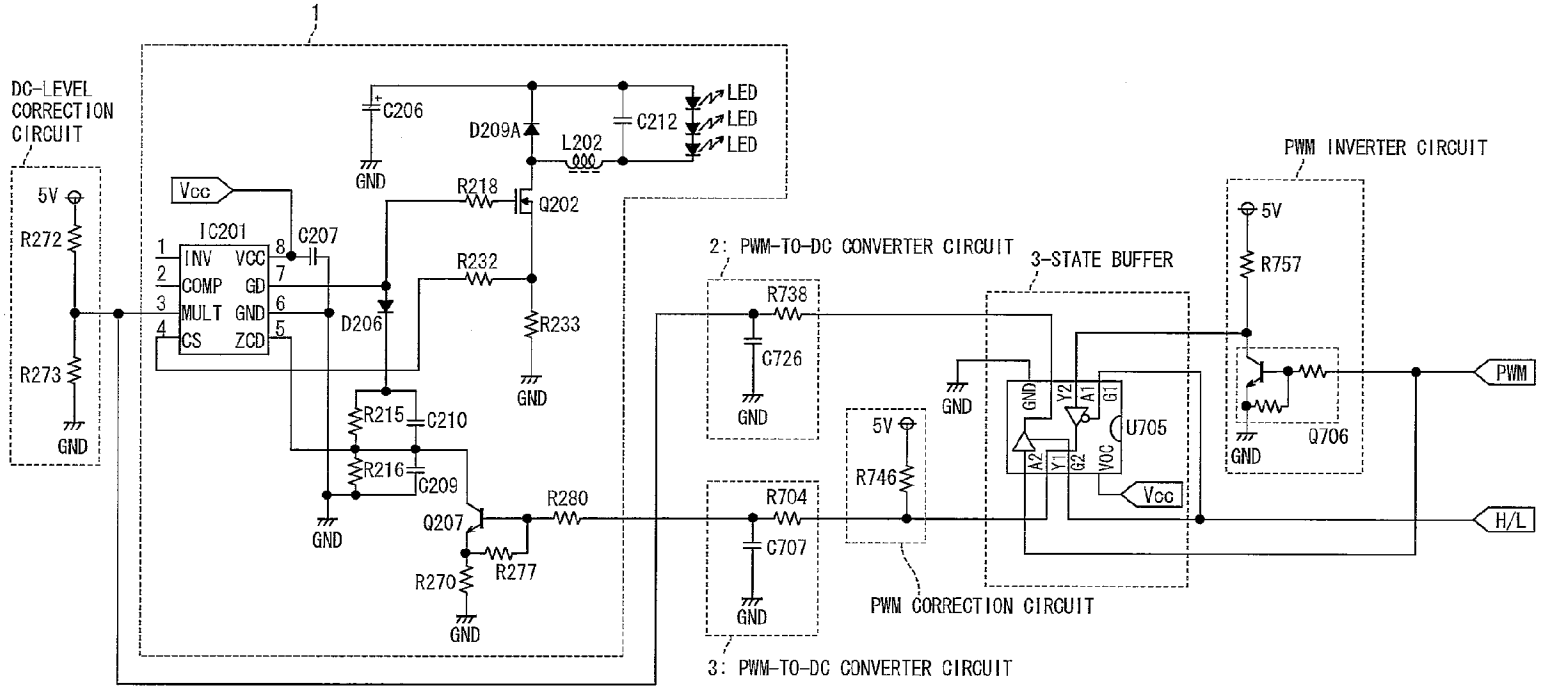
FIG. 10 is a circuit diagram showing an example in which a circuit employs a 3-state buffer IC allowing a single light control PWM signal source to achieve DC light control and PDM light control.

FIG. 10 is a modification in which the DC signal sources DC1 and DC2 (in FIG. 1) for respectively controlling a DC light control index and a PDM light control index are created from a single PWM light control signal source.

A circuit 1 in FIG. 10 is equivalent to the LED drive circuit shown in FIG. 1. Also, circuits 2 and 3 in FIG. 10 are equivalent to the circuit shown in FIG. 6. An HL signal and a PWM signal located on the right side of FIG. 10 are control signals. The HL signal is directly supplied to a 3-state buffer IC, a U705, and is inverted in a G1 terminal of the U705. For example, when the HL signal is a high level, an A2 terminal and a Y2 terminal become active. As such, a signal supplied to the A2 terminal is outputted from the Y2 terminal. Meanwhile, a Y1 terminal is in high impedance, regardless of whether a low level or a high level is supplied to an A1 terminal.

This causes the circuit of FIG. 10 to select the DC light control. Therefore, a PWM signal is supplied to the A2 terminal of the U705, and is outputted, as it is, from the Y2 terminal. The PWM signal outputted from the Y2 terminal is (i) converted into a DC signal by a PWM-to-DC converter circuit 2 which is an integration circuit including an R738 and a C726 and then (ii) supplied to an MULT terminal of an IC201. As early described, the MULT terminal of the IC201 is an input terminal for the multiplier. An electric current which flows to an LED can be adjusted in accordance with a voltage level supplied to the MULT terminal. Note that a circuit including an R272 and an R273 shown in FIG. 10 is a DC-level correction circuit for correcting an absolute value of a voltage supplied to the MULT terminal. Also note that the DC-level correction circuit fixes a voltage of the MULT terminal of the IC201, in a case where the PDM light control is selected in response to a low level of an HL signal so that the Y2 terminal of the U705 becomes high impedance (later described). It follows that a voltage, which is divided by resistances of the R272 and the R273, determines the maximum value of a current flowing to the LED during the PDM light control (later described).

In the case where the HL signal has a low level, the A1 terminal and the Y1 terminal become active, and a signal supplied to the A1 terminal is outputted from the Y1 terminal, whereas the Y2 terminal becomes high impedance, regardless of whether a low level or a high level is supplied to the A2 terminal. This causes the circuit of FIG. 10 to select the PDM light control. A PWM signal is supplied, via a PWM inverter circuit including a Q706 and an R757, to the Y2 terminal of the U705, and is then outputted from the A2 terminal of the U705. This PWM signal outputted from the A2 terminal (i) gets its level corrected by an R746, (ii) is converted into a DC signal by a PWM-to-DC converter circuit 3 which serves as an integration circuit including an R704 and a C707, and (iii) is supplied, via an R280, to an emitter follower circuit including a Q207.

Figure 11:
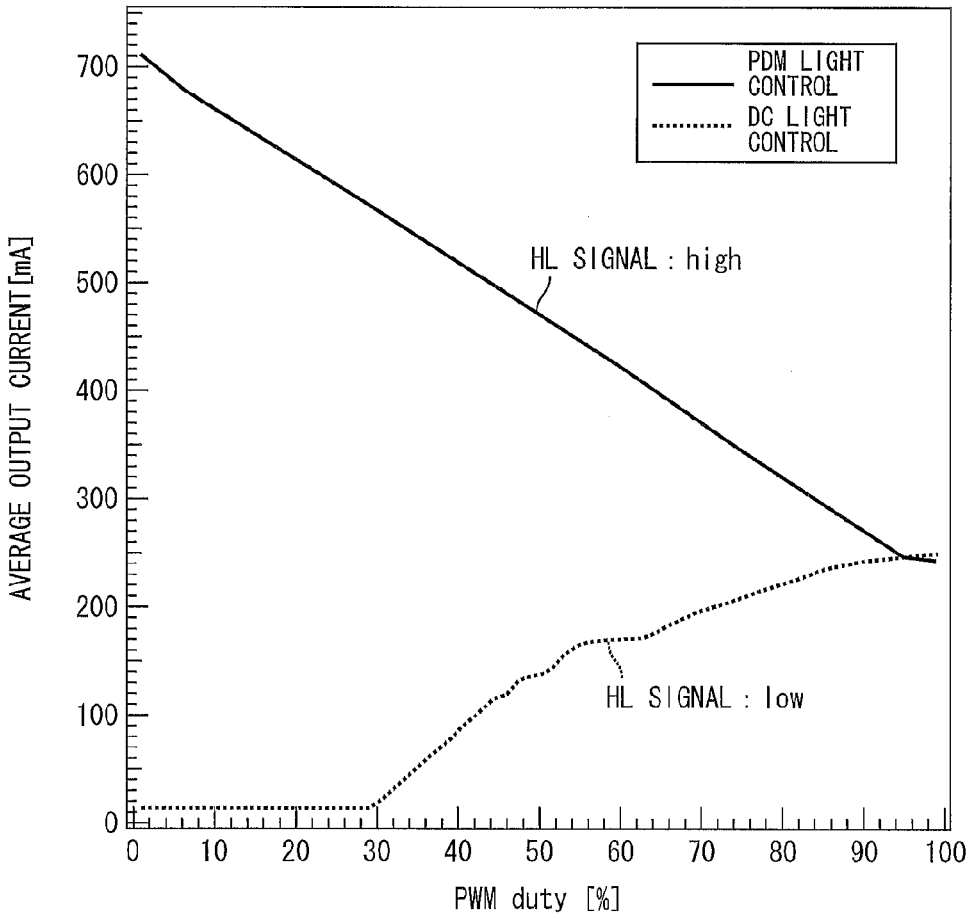
FIG. 11 is a graph illustrating an example relationship in the circuit shown in FIG. 10 between an average output current of an HL signal and an "on-duty" ratio of the PWM signal.

A relationship between an "on-duty" ratio of a PWM signal (see the right side of FIG. 10) and a light control rate is as shown in FIG. 11. In other words, FIG. 11 shows an example relationship between an average output current of an HL signal and the "on-duty" ratio of the PWM signal.

The present invention is not limited to the description of the embodiments, but can be altered by a skilled person in the art within the scope of the claims. An embodiment derived from a proper combination of technical means disclosed in different embodiments is also encompassed in the technical scope of the present invention.

(Summary of Key Points)

It is preferable to arrange an LED drive circuit of the present invention such that the following inequality is met:

$$f(\text{dim.min})>20\text{ kHz and } f(\text{max})>f(\text{dim.max})$$

where (i) f(dim.min) is an average oscillation frequency during a minimum audible light control, (ii) f(dim.max) is an average oscillation frequency during a maximum light control, and (iii) f(max) is a maximum average oscillation frequency.

With the configuration, noises can be prevented by arranging the LED drive circuit to meet the inequality, f(dim.min) >20 kHz. In addition, by arranging the LED drive circuit to meet the inequality, f(max)>f(dim.max), it is made possible to (i) suppress an oscillation frequency in the vicinity of a region where (a) the light control is carried out at 100% and (b) a large amount of heat is generated and (ii) reduce switching loss even more.

Moreover, the LED drive circuit can be configured such that: an on period of a DC-to-DC converter is determined by (i) a pulse height of a pulse current generated by the DC-to-DC converter and (ii) a current slope caused by an L value of an inductor included in the DC-to-DC converter; and an off period of the DC-to-DC converter is determined by a type of technique commonly used in an analog circuit.

With the configuration, the LED drive circuit indirectly determines an on period and an off period of a converter without determining by respective temporal absolute values. This leads an oscillation frequency to contain a small frequency fluctuation caused by a periodic current fluctuation (pulsating flow) of an input voltage. This makes it possible to (i) prevent unwanted radiation from concentrating on a specific frequency and (ii) reduce a level of noise radiation as compared with a case where an on period and an off period are directly determined as temporal absolute values by a microcomputer etc.

Furthermore, the LED drive circuit can be configured such that a control IC having a function to adjust an off period of the DC-to-DC converter is used, the control IC adjusting the off period when an analog signal, serving as a control signal, is supplied to an emitter follower circuit connected to a terminal of the control IC, the terminal determining the off period.

Furthermore, the LED drive circuit can be configured such that a 3-state buffer IC is used, the 3-state buffer IC allowing DC light control and PDM light control to be carried out by use of a single light control PWM signal source.

INDUSTRIAL APPLICABILITY

The present invention is applicable to an LED drive circuit of buck converter type or of buck-boost converter type.

REFERENCE SIGNS LIST

L202 Inductor (DC-to-DC converter)
Q202 Transistor (DC-to-DC converter)
D209A Diode (DC-to-DC converter)
C212 Capacitor (DC-to-DC converter)
IC201 Control IC
U705 3-state buffer IC

The invention claimed is:

1. An LED drive circuit that carries out, by use of a DC-to-DC converter, control of brightness of light of an LED, the LED drive circuit comprises:

(i) a control IC having a function to adjust an off period of oscillation of the DC-to-DC converter;

(ii) an emitter follower circuit connected to a terminal of the control IC, the terminal determining the off period of oscillation of the DC-to-DC converter;

(iii) a first DC voltage supply connected to a MULT terminal of the control IC; and (iv) a second DC voltage supply connected to the emitter follower circuit, wherein the control of the brightness of light being carried out, in a first range of brightness where a brightness control level is equal to or greater than a certain brightness control level, by adjusting a pulse height of an LED drive current based on the first DC voltage supply and the second DC voltage supply, and the brightness control being carried out, in a second range where the brightness control level is equal to or less than the certain brightness control level, by adjusting the off period of oscillation of the DC-to-DC converter based on the first DC voltage supply and the second DC voltage supply, wherein voltages of the first DC voltage supply and the second DC voltage supply are variable, wherein the brightness control is carried out so that:

$$f(\text{dim.min})>20\text{ kHz and }f(\text{max})>f(\text{dim.max})$$

where (i) f(dim.min) is an average oscillation frequency during a minimum audible brightness control, (ii) f(dim.max) is an average oscillation frequency during a maximum brightness control, and (iii) f(max) is a maximum average oscillation frequency.

2. The LED drive circuit as set forth in claim 1, wherein a 3-state buffer IC is used, the 3-state buffer IC allowing DC light control and PDM light control to be carried out by use of a single light control PWM signal source.

3. An LED driving method for carrying out, by use of a DC-to-DC converter, control brightness of light of an LED, comprising the steps of:

carrying out the control of the brightness of light, in a first range where a brightness control level is equal to or greater than a certain brightness control level, by adjusting a pulse height of an LED drive current, wherein a DC voltage of a second DC voltage supply connected to an emitter follower circuit is fixed to a maximum voltage whereas a DC voltage of a first DC voltage supply connected to a MULT terminal of a control IC is adjusted, and carrying out the brightness control, in a second range where the brightness control level is equal to or less than the certain brightness control level, by adjusting an off period of oscillation of the DC-to-DC converter, wherein the DC voltage of the first DC voltage supply is fixed whereas the DC voltage of the second DC voltage supply is reduced, wherein the brightness control is carried out so that:

$$f(\text{dim.min})>20\text{ kHz and }f(\text{max})>f(\text{dim.max})$$

where (i) f(dim.min) is an average oscillation frequency during a minimum audible brightness control, (ii) f(dim.max) is an average oscillation frequency during a maximum brightness control, and (iii) f(max) is a maximum average oscillation frequency.

* * * * *